US009220312B2

(12) United States Patent
Allmann

(10) Patent No.: US 9,220,312 B2
(45) Date of Patent: Dec. 29, 2015

(54) SAFETY SKI BINDING SYSTEM

(71) Applicant: Andreas Allmann, Unterwasser (CH)

(72) Inventor: Andreas Allmann, Unterwasser (CH)

( * ) Notice: Subject to any disclaimer, the term of this patent is extended or adjusted under 35 U.S.C. 154(b) by 0 days.

(21) Appl. No.: 14/299,601

(22) Filed: Jun. 9, 2014

(65) Prior Publication Data

US 2014/0361514 A1 Dec. 11, 2014

(30) Foreign Application Priority Data

Jun. 10, 2013 (DE) ..... 10 2013 009 762

(51) Int. Cl.

| | |
|---|---|
| ***A63C 9/08*** | (2012.01) |
| ***A43B 5/04*** | (2006.01) |
| ***A63C 9/086*** | (2012.01) |
| ***A63C 9/081*** | (2012.01) |

(52) U.S. Cl.

CPC ..... *A43B 5/047* (2013.01); *A43B 5/0417* (2013.01); *A43B 5/0419* (2013.01); *A63C 9/081* (2013.01); *A63C 9/086* (2013.01)

(58) Field of Classification Search

CPC ..... A63C 10/10; A63C 10/106; A63C 10/12; A63C 9/0844; A63C 9/0845; A63C 9/0846; A63C 9/086; A63C 9/08592; A63C 9/08578; A63C 9/081; A43B 5/047; A43B 5/0417; A43B 5/0419

See application file for complete search history.

(56) References Cited

U.S. PATENT DOCUMENTS

| | | | | |
|---|---|---|---|---|
| 3,244,431 | A * | 4/1966 | Hatlapa | 280/614 |
| 3,606,368 | A * | 9/1971 | Smolka et al. | 280/613 |
| 3,608,919 | A * | 9/1971 | Lollmann et al. | 280/613 |
| 3,689,096 | A * | 9/1972 | Ribi | 280/613 |
| 3,695,623 | A * | 10/1972 | Covini | 280/613 |
| 3,817,542 | A * | 6/1974 | Zaagman | 280/615 |
| 3,869,136 | A * | 3/1975 | Jackson | 280/613 |
| 3,870,327 | A * | 3/1975 | Betschart, Jr. | 280/618 |
| 3,905,613 | A * | 9/1975 | Romeo | 280/623 |
| 3,924,869 | A * | 12/1975 | Strub | 280/613 |
| 3,931,980 | A * | 1/1976 | Marker | 280/611 |
| 4,002,354 | A * | 1/1977 | Ramer | 280/614 |
| 4,348,036 | A * | 9/1982 | Settembre | 280/615 |
| 4,480,850 | A * | 11/1984 | Schneider | 280/630 |
| 4,505,493 | A * | 3/1985 | Gustavsson | 280/617 |
| 4,516,792 | A * | 5/1985 | Scheck et al. | 280/625 |
| 4,640,026 | A * | 2/1987 | Kirsch | 280/613 |
| 4,653,203 | A * | 3/1987 | De Mattheis | 280/613 |
| 4,923,207 | A * | 5/1990 | Pozzobon | 280/613 |
| 4,960,289 | A * | 10/1990 | Stritzl et al. | 280/630 |
| 4,974,869 | A * | 12/1990 | Muhlberger et al. | 280/625 |
| 5,020,823 | A * | 6/1991 | Bogner | 280/634 |

(Continued)

FOREIGN PATENT DOCUMENTS

| | | |
|---|---|---|
| CH | 644 026 A5 | 7/1984 |
| DE | 25 11 332 | 9/1975 |

(Continued)

*Primary Examiner* — Hau Phan

*Assistant Examiner* — Jacob Meyer

(74) *Attorney, Agent, or Firm* — Dilworth & Barrese, LLP.

(57) ABSTRACT

The invention relates to a safety ski binding system for the releasable fixing of a ski boot to a ski having an adjustable release mechanism and fixed holding elements. In accordance with the invention, two latching elements which each project laterally from the ski boot and which cooperate with a holder element formed fixed to the ski as a heel holder are arranged at the ski boot. The invention further relates to a ski boot which forms a part of the aforesaid safety binding system.

11 Claims, 3 Drawing Sheets

(56) References Cited

U.S. PATENT DOCUMENTS

| | | | | |
|---|---|---|---|---|
| 5,028,069 | A * | 7/1991 | Janisch et al. | 280/625 |
| 5,050,903 | A * | 9/1991 | Stritzl et al. | 280/625 |
| 5,116,074 | A * | 5/1992 | Peyre | 280/618 |
| 5,240,275 | A * | 8/1993 | Jungkind | 280/618 |
| 5,318,320 | A * | 6/1994 | Ramer | 280/614 |
| 5,529,331 | A * | 6/1996 | Hoelzl et al. | 280/634 |
| 5,551,720 | A * | 9/1996 | Ruffinengo | 280/602 |
| 5,697,631 | A * | 12/1997 | Ratzek et al. | 280/613 |
| 5,743,550 | A * | 4/1998 | Frohwein | 280/612 |
| 6,017,042 | A * | 1/2000 | Paris | 280/14.21 |
| 6,105,996 | A * | 8/2000 | France | 280/624 |
| 6,257,613 | B1 * | 7/2001 | Porte | 280/617 |
| 6,322,096 | B2 * | 11/2001 | Porte | 280/617 |
| 6,375,212 | B1 * | 4/2002 | Hillairet et al. | 280/617 |
| 6,575,490 | B1 * | 6/2003 | Laughlin | 280/618 |
| 6,585,282 | B2 * | 7/2003 | Merino et al. | 280/634 |
| 8,336,903 | B2 * | 12/2012 | Furr et al. | 280/618 |
| 8,439,389 | B2 * | 5/2013 | Moore et al. | 280/617 |
| 8,807,586 | B2 * | 8/2014 | Lehner et al. | 280/611 |
| 8,936,252 | B2 * | 1/2015 | Merino et al. | 280/11.32 |
| 2007/0035108 | A1 * | 2/2007 | Krumbeck et al. | 280/626 |
| 2011/0025003 | A1 * | 2/2011 | Moore et al. | 280/11.33 |

FOREIGN PATENT DOCUMENTS

| | | | |
|---|---|---|---|
| DE | 29 27 059 | | 1/1980 |
| DE | 31 22 576 | | 6/1982 |
| DE | 31 22 577 | A1 | 6/1982 |
| DE | 31 41 425 | | 11/1982 |
| DE | 600 14 753 | | 10/2005 |
| EP | 1 050 326 | A1 | 11/2000 |
| EP | 1 674 138 | | 7/2008 |
| FR | 2 251 343 | A1 | 6/1975 |
| FR | 2 561 114 | | 9/1985 |

* cited by examiner

SAFETY SKI BINDING SYSTEM

BACKGROUND OF THE INVENTION

The invention relates to a safety binding system for the releasable fixing of a ski boot to a ski having an adjustable release mechanism and fixed holding elements in accordance with the description herein.

Ski bindings have a toe holding unit, also called a toe piece, and a heel holding unit, also called a heel piece, for holding ski boots corresponding to certain standards. Such standards are laid down, for example, in the German industrial standard (DIN ISO 5355). These standardized ski boots have a front connection region for the cooperation with the toe piece of the ski binding and a rear connection region for the cooperation with the heel holder of the ski binding. The lower side of the sole of the standard ski boot is of planar configuration. The front contact surface and the rear contact surface of the ski binding therefore typically extend in a plane parallel to the ski. Due to this shaping, the ski boot cannot be adapted with respect to the anatomy and the movement comfort for the wearer. The movement process when walking with these standardized ski boots is correspondingly difficult.

Conventional ski bindings are, however, dependent on the cooperation with the standardized ski boots.

SUMMARY OF THE INVENTION

It is now the object of the present invention to provide a safety ski binding system in which the ski boot to be fixed no longer has to correspond to the ski boot sole standard, but rather in which the boot sole can be designed better with respect to the anatomy and the movement comfort to allow the skier better freedom of movement when walking with the ski boots.

This object is satisfied in accordance with the invention by a safety ski binding system having the features herein.

For this purpose, the safety ski binding system for the releasable fixing of a ski boot to a ski comprises an adjustable release mechanism and fixed holding elements. Two latching elements which each project laterally from the ski book and which cooperate with a holder element formed fixed to the ski as a heel holder are arranged at the ski boot. It is possible due to the new conceptualization of the safety ski binding system to adapt the ski boot sole to the skier's anatomy to improve the movement comfort for the skier, i.e. to design it as regionally arched or sloped over the footfall surface.

Preferred embodiments of the invention result from the description herein.

It is thus possible in accordance with a preferred embodiment of the invention that the adjustable release mechanism is respectively integrated in the ski boot. The adjustable release mechanism is then advantageously coupled to the holding element fixed to the ski and configured as a heel holder on stepping into the ski.

The adjustable release mechanism particularly advantageously has an actuating mechanism acting on the two latching elements which each project laterally from the ski boot and are longitudinally displaceable with respect to it.

The latching elements can advantageously be locking rollers respectively rotatably supported on pins. The actuating mechanism itself can be formed by at least one spring element and/or at least one spring damper element. Alternatively, magnetic or electronic mechanisms can also be used which form the actuating mechanism via corresponding sensors, for example pressure sensors.

The adjustable release mechanism is particularly advantageously formed in a heel part of the ski boot which forms a unit with a shell substantially forming the ski boot.

In addition, a front part having a fixing and release rail can form a unit with the shell substantially forming the ski boot.

The at least one actuating mechanism can be adjustable toward two sliders which are mutually displaceable via an adjustment mechanism to set the contact pressure of the locking rollers.

The fixed holding elements fixed to the ski can have two locking links disposed opposite one another with respect to the ski center axis for receiving the latching elements. The locking links are preferably each arranged laterally on a turntable rotatable with respect to the ski.

The fixed holding elements fixed to the ski in accordance with a further preferred embodiment variant of the invention have toe pieces which are configured as a rigid sole clamp which cooperates with the front part having the fixing and release rail.

Furthermore, the toe pieces can each have lateral guide rollers whose axes of rotation are aligned perpendicular to the ski so that a lateral release of the ski boot is assisted here.

The previously described ski binding system can be designed as a ski binding/boot system integrated in a modular fashion. In the previously described embodiment variants, the actuating element formed by way of example as a spring tensioning element is integrated in the heel of the ski boot sole. The ski boot cooperates with the fixed binding element which can advantageously be formed as a binding element plate which includes the toe holding unit and the heel holding unit. This plate including the binding elements can be connected to the ski in a simple manner if the ski has increased regions forming respective undercuts into which the binding plate can be received in a shape-matched manner (cf. in this respect EP 1 674 138 B1 to which reference is made).

The adjustment of the binding release value, i.e. the so-called Z value, can be made directly at the ski boot by the integration of the actuating element preferably configured as a spring tensioning element in the ski boot sole. This results in a considerable advantage since the adaptation of the binding at the ski side which has to be carried at regularly—in particular in the rental sector—is omitted and the respective adjustment can be made individually in the ski boot of the skier.

Furthermore, the binding unit at the ski side is substantially simplified so that the system weight can be considerably reduced. The binding becomes more robust overall due to the simplified and reduced parts and can furthermore be produced less expensively.

The invention finally relates to a ski boot which forms a part of a safety binding system of the aforesaid type, with this ski boot having a ski boot shell in which a heel part having the latching elements and a front part having a fixing and release rail are integrated.

BRIEF DESCRIPTION OF THE DRAWINGS

Further features, details and advantages of the invention will be explained in more detail with reference to an embodiment shown in the drawing. There are shown.

DESCRIPTION OF THE PREFERRED EMBODIMENTS

Figure 1:
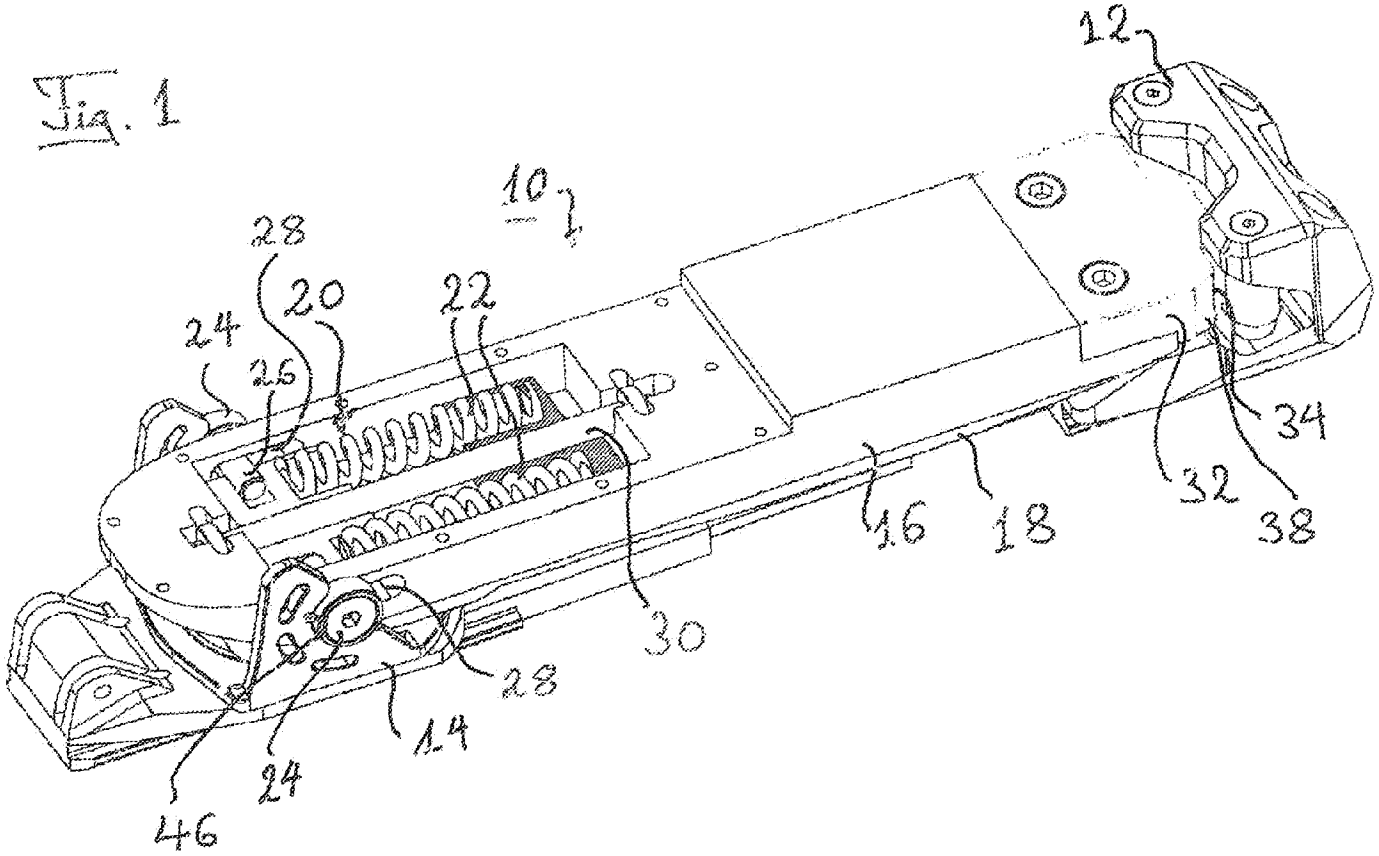
FIG. 1: a perspective representation of the main functional parts in accordance with an embodiment variant of the safety ski binding system in accordance with the invention.

An embodiment variant of the safety ski binding system 10 in accordance with the invention is shown in FIGS. 1 to 6. Only the parts necessary for the function are shown here for a better illustration of the safety ski binding system 10. In FIG. 1, the fixed binding components fixed to the ski are shown which comprise the toe piece (also called a toe holder unit) 12 and the heel holder (also called a heel holder unit) 14. A ski boot, of which only the sole region 16 is shown in FIG. 1, engages into the toe piece 12 and the heel holder 14.

Figure 2:
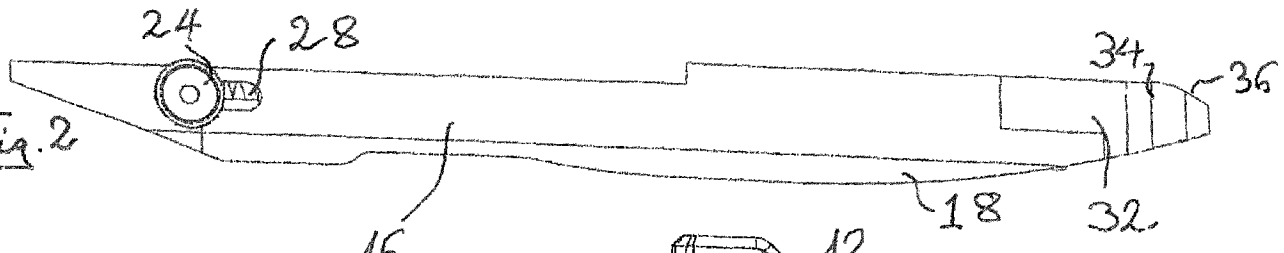
FIG. 2: a side view of a part of a ski boot in accordance with the safety ski binding system in accordance with FIG. 1.
Figure 3:
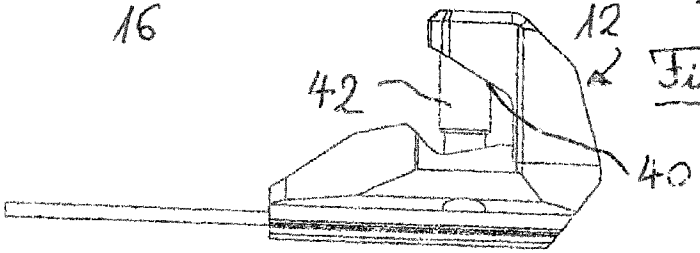
FIGS. 3 and 4: a lateral representation and a perspective representation respectively of the toe pieces of the ski binding.

It can be seen from the perspective view in accordance with FIG. 1 and from the side view in accordance with FIG. 2 that the sole region 16 is not formed as flat on its lower side, but rather regionally has sloped or arched portions 18 so that the total ski boot is adapted anatomically better to the skier. The shape of the lower side of the ski boot sole is in this respect provided such that the skier can "roll off" better when walking in the ski boots so that even less skilled skiers have maximum movement comfort and a high movement security when walking in the ski boots. The risk of falling and/or of injury—for example when climbing stairs—is therefore considerably reduced.

In the embodiment shown in FIGS. 1 to 6, the adjustable release mechanism 20 of the safety ski binding system 10 is arranged in the sole region 16 of the ski boot. As is, for example, shown with respect to FIG. 1, the release mechanism comprises two parallel pressure springs 22 which act in a manner to be described in more detail in the following on two latching elements 24 projecting laterally from the ski boot sole 16. The latching elements are configured as locking rollers 24 which are rotatably supported about pins 26. The pins 26 are in turn arranged longitudinally displaceably in corresponding elongate holes 28 in the sole region 16. An adjustment mechanism via which the contact pressure of the latching rollers 24 can be set is marked by 30 in FIG. 1. The bind release value (so-called Z value) can be set via this contact pressure.

Instead of the spring mechanism shown here, a spring damping mechanism can also be provided in which an oil damper is additionally installed. Alternatively, a magnetic, electromagnetic or electronically releasable actuating mechanism can also be provided here in which the latching elements 24 are acted on with the desired holding force via corresponding actuating members and sensors.

As shown in FIG. 1, the release mechanism 20 is arranged in the region of the heel of the ski boot. The heel part of the sole region 16 is preferably an integrated part of the total ski boot shell together with the latching elements 24.

A front part 32 which has a correspondingly shaped fixing and release rail 34 is formed opposite the heel part of the sole region 16 of the ski boot. The fixing and release rail 34 in this respect has sloped release surfaces 36 (cf. FIG. 1 and FIG. 2) as well as rounded side edges 38 (cf. FIG. 1).

The fixing and release rail 34 formed at the front part 32 cooperates with the toe piece 12. The design of the toe piece 12 is shown in detail in FIGS. 3 and 4. For an upward release, the toe pieces 12, which are otherwise fixedly connected to the ski, not shown in any more detail here, have sloped surfaces 40 which cooperate with the sloped release surfaces 36 of the fixing and release rail 34 (cf. FIG. 1 and FIG. 6 respectively).

Laterally, the toe pieces 12 each have guide rollers 42 whose axes of rotation are aligned perpendicular to the ski, not shown in any more detail here, and thus also to the ski boot sole 16. These guide rollers 42 cooperate with the rounded side edges 38 of the fixing and release rail 34 for the lateral release of the ski binding system.

Figure 5:
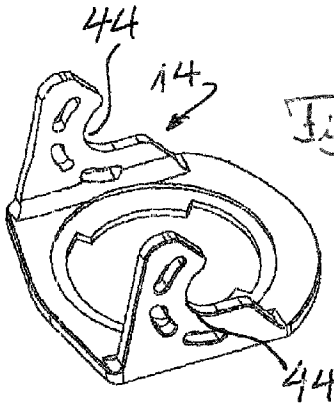
FIG. 5: a detail of the heel holder in accordance with the ski binding system in accordance with FIG. 1.
Figure 4:
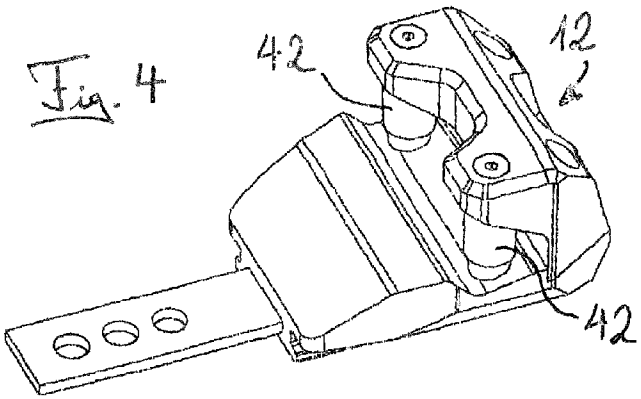

FIG. 5 shows a representation of the heel holder 14 fixedly mounted to the ski as an individual component. This heel holder is arranged on a turntable, not shown in any more detail, with respect to the ski. This means that the heel holder 14 can rotate about a central axis of rotation relative to the ski.

The heel holder 14 has two locking links 44 which are oppositely disposed with respect to the ski center axis and which cooperate with the latching elements 24 formed as locking rollers. In this respect, the manner of cooperation can be seen from FIGS. 1 and 6. The locking rollers 24 are shown in the latched position in FIG. 1. For this purpose, the locking rollers engage into a region 46 of the locking link 44 adapted to the outer radius of the locking rollers 24. The locking rollers 24 are held in their latching position via the pressure springs 22.

Figure 6:
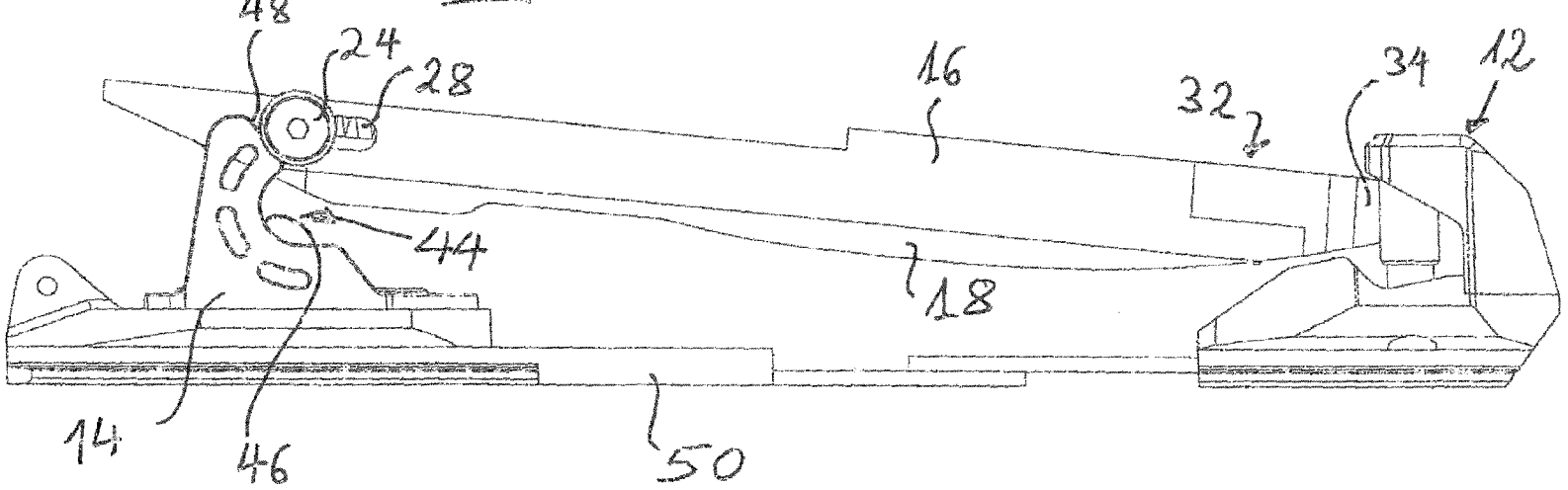
FIG. 6: a lateral representation of the ski binding system in accordance with FIG. 1 during the latching of the ski boot into the binding.

FIG. 6 shows the situation on the stepping of the ski boot, i.e. of the sole region 16 of the ski boot shown here, into the ski binding. For this purpose, the front part 32 of the ski boot is pushed with its fixing and release rail 34 beneath the toe pieces 12. The locking rollers 24 of the heel region of the sole region 16 are placed onto the locking links 44 of the heel holder 14 which are correspondingly formed as sloped edges 48 in the upper region onto which the locking rollers 24 impact on pressing down the sole region 16. On the pressing down of the heel region of the sole region 16, the locking rollers 24 are displaced along the sloped edges 48 of the locking links 44 of the heel holder 14 and are displaced against the force of the pressure springs 22 along the elongate holes 28 so that the locking rollers 24 move into the latching position in accordance with FIG. 1 on a further pressing down of the heel region of the sole region 16 of the ski boot.

As can be seen from FIG. 6, the toe pieces 12 and the heel holder 14 are connected to one another on an assembly plate 50. This assembly plate 50 can, as explained in detail with reference to EP 1 674 138 B1, be connected to a ski, not shown here, in as simple manner. For this purpose, the binding reception plate 50 is integrated as a bearing part in the central region of the ski in which it is inserted in that it is laterally encompassed in a shape-matched manner by elevated regions of the ski body. A longitudinal displacement with respect to the ski is likewise prevented in a known manner via an additional screw or another securing element.

All release functions can be realized in a simple manner using the new safety ski binding system.

On a lateral release, the ski boot is pressured rearward via the guide rollers 42, whereby the pressure springs 20 are compressed and the boot is guided laterally out of the toe pieces 12. In this respect, the turntable allows a largely friction-free and controlled guiding of the boot to the side up to the release of the sole region 16.

A forward release takes place by the upward force action of the heel. The locking rollers 24 are thereby pressed forward by the region 46 of the locking links and are led upward via the links. As soon as the locking rollers 24 unlatch from the region 46 of the locking links, the pressure springs are relaxed and the boot is released from the binding.

On the rearward release, the release mechanism, i.e. the pressure springs 22, is compressed by the rearward and upward force action via the locking rollers 24. The front part 32 is thereby pressed upward over the sloped release surface 36 of the fixing and release rail 34 along the sloped surface 40 of the toe pieces 12 until the ski boot is released.

The invention claimed is:

1. A safety ski binding system for the releasable fixing of a ski boot to a ski having an adjustable release mechanism (20) and fixed holding elements (12, 14), wherein two latching elements (24, 24) which each project laterally from the ski boot and which cooperate with a holding element (14) formed fixed to the ski as a heel holder are arranged at the ski boot, the latching elements (24, 24) are each formed as locking rollers respectively rotatably supported on pins (26, 26), the heel holder (14) comprises a pair of locking links (44, 44) oppositely disposed with respect to a center axis of the ski and each arranged to receive a reserve locking roller (24), each said locking link (44) having a region (46) configured to an outer radius of the locking roller (24) and pen towards a front of the ski, and a downwardly sloped edge (48) towards the front of the ski and above the region (46), and the adjustable release mechanism (20) has an actuating mechanism (22) comprising two parallel pressure springs (22, 22) disposed on opposite sides of the center axis of the ski and arranged to bias the pins (26) backwardly to retain the locking rollers (44) in the respective regions (46) of the heel holder (14).

2. A safety ski binding system in accordance with claim 1, wherein the adjustable release mechanism is respectively integrated in the ski boot.

3. A safety ski binding system in accordance with claim 1, wherein the adjustable release mechanism is formed in a heel part which forms a unit with a shell substantially forming the ski boot.

4. A safety ski binding system in accordance with claim 1 wherein a front part having a fixing and release rail additionally forms a unit with a shell substantially forming the ski boot.

5. A safety ski binding system in accordance with claim 1, wherein the locking links are each arranged laterally on a turntable rotatable with respect to the ski.

6. A safety ski binding system in accordance with claim 1, wherein the fixed holding elements (12, 14) fixed to the ski have toe pieces which are configured as a rigid sole clamp which cooperates with a front part having a fixing and release rail.

7. A safety ski binding system in accordance with claim 6, wherein the toe pieces each have lateral guide rollers whose axes of rotation are aligned perpendicular to the ski.

8. A ski boot which forms a part of a safety ski binding system in accordance with claim 1, and having a ski boot shell in which a heel part having the latch elements and a front part having a fixing and release rail are integrated.

9. A safety ski binding system in accordance with claim 3, wherein the shell (16) is formed with a sloped or arched portion (18) on a lower side thereof to anatomically adapt to a skier.

10. A safety ski binding system in accordance with claim 1, additionally comprising a toe holder (12) at a front end opposite a position of the heel holder (14) and fixedly connected to the ski, the toe holder (12) having sloped surfaces (40) and guide rollers (42) mounted with axes of rotation perpendicular to the ski, a rail (34) mounted upon a front part (32) of the ski boot and having sloped surfaces (36) with rounded edges (38), with the sloped surfaces (40, 36) of the toe holder (12) and rail (34) arranged to cooperate with one another and the guide rollers (42) and rounded edges (38) arranged to cooperate for lateral release of the ski binding system.

11. A safety ski binding system for the releasable fixing of a ski boot to a ski having an adjustable release mechanism (20) and fixed holding elements (12, 14) wherein two latching elements (24, 24) which each project laterally from the ski boot and cooperate with a holding element (14) formed fixed to the ski as a heel holder, are arranged at the ski boot, the adjustable release mechanism (20) has an actuating mechanism (22) acting on the holding element (14) formed as a heel holder, the latching elements (24, 24) are locking rollers respectively rotatably supported on pins (26, 26), and the at least one actuating mechanism (22) is adjustable with respect to two sliders displaceable with respect to one another via an adjustment mechanism (30) to bias and set a contact pressure of the locking rollers on the holding element (14) formed as the heel holder.

* * * * *